US006243991B1

(12) United States Patent
Iritani

(10) Patent No.: US 6,243,991 B1
(45) Date of Patent: Jun. 12, 2001

(54) VARIABLE FLOOR HEIGHT TIERED STAND

(75) Inventor: Yoshiaki Iritani, Tokyo (JP)

(73) Assignee: Kabushikikaisya Kotobuki, Tokyo (JP)

( * ) Notice: Subject to any disclaimer, the term of this patent is extended or adjusted under 35 U.S.C. 154(b) by 0 days.

(21) Appl. No.: 09/463,303

(22) PCT Filed: May 22, 1998

(86) PCT No.: PCT/JP98/02243

§ 371 Date: Mar. 28, 2000

§ 102(e) Date: Mar. 28, 2000

(87) PCT Pub. No.: WO99/61726

PCT Pub. Date: Dec. 2, 1999

(51) Int. Cl.[7] ..... E04H 3/12
(52) U.S. Cl. ..... 52/8; 52/9; 52/6; 52/183
(58) Field of Search ..... 52/6, 7, 8, 9, 10, 52/183

(56) References Cited

U.S. PATENT DOCUMENTS 3,885,365 * 5/1975 Cox ..... 52/183
4,862,650 * 9/1989 Brasil ..... 52/9
5,660,000 * 8/1997 MacIntyre ..... 52/9
6,003,270 * 12/1999 MacInyre ..... 52/10

FOREIGN PATENT DOCUMENTS 33-14837 9/1958 (JP) .
2-115855 9/1990 (JP) .

* cited by examiner

*Primary Examiner*—Christopher T. Kent
*Assistant Examiner*—Jennifer I. Thissell
(74) *Attorney, Agent, or Firm*—Young & Thompson

(57) ABSTRACT

Variable floor height tiered stands installed in a gymnasium, auditorium, indoor or outdoor athletic field or the like, including tiered floor members of which displacement in the fore-and-after direction and variation in depth are minimized when their inclination is changed, thereby to maintain constant the planar projected space of the stands in the architectural plan and to eliminate the risk of interference between the stands and any stationary structure in changing the inclination.

9 Claims, 13 Drawing Sheets

VARIABLE FLOOR HEIGHT TIERED STAND

TECHNICAL FIELD

The present invention relates to tiered stands installed in indoor facility such as gymnasium, auditorium or multipurpose hall, or indoor or outdoor athletic field or the like, and pertains in particular to variable floor height tiered stands wherein each of the tiered floor members can be synchronously displaced vertically upwards or downwards whenever necessary in order to change the height of the floor members depending upon the intended use of the facility.

BACKGROUND ART

When, for example, a stadium for ice hockey game as shown in FIG. 1 is used as a stadium for a basketball game as shown in FIG. 2, with a basket court 50 arranged at the center area, it would be desirable to be able to accommodate as increased number of spectators as possible. In this instance, in addition to the existing tiered stands 51 in the stadium, it has been a conventional practice generally adopted in the United States or in other countries to arrange separate stands 52 between the existing stands 51 and the basket court 50 as seen in the longitudinal direction of the stadium. The same is true when, for example, an athletic stadium is to be used as a concert hall by removing part of the tiered stands on one longitudinal side of the stadium and arranging a stage 53 on that side, as shown in FIG. 3.

When a stadium is used for various purposes as exemplified above, it is preferred that the inclination of the tiered stands as a whole can be changed as required in relation to the intended use. Thus, in the above-mentioned examples, in order to watch an ice hockey game, it is desirable to achieve a steep inclination of the stands and thereby realize a wide visual field, as shown in FIG. 4(*a*) which is a schematic sectional view of the tiered stands. On the other hand, for watching a basket ball game, in view of the fact that the basket court itself is not large, and by further taking into account the required number of the additional stands, it is desirable to achieve an intermediate inclination by increasing the height of the tiered stands on the lower side. Furthermore, when the stadium is used as a concert hall, it is highly important that as many stands 52 as possible are arranged on the front side of the tiered stands 51. Thus, the height of the tiered stands 52 on the lower side is further increased as shown in FIG. 4(*c*) to achieve a less steep inclination.

In the examples shown in FIGS. 3 and 4(*c*), the tiered stands 51 situated on the side of the stage 53, either partly or in their entirety, may be arranged such that they are of a telescopic structure wherein the floors on the lower side are retraced below the floors on the upper side, thereby allowing the stage 53 to be installed. However, since such an arrangement, per se, is not a direct subject matter of the present invention, a detailed explanation will be omitted.

The inclination of the tiered stands 51 as a whole can be readily changed, for example, in the manner as shown in a schematic side view of FIG. 5(*a*). In this instance, among the horizontal floor members $F_1$ to $F_n$ arranged in the form of tiers, the location corresponding the rear end of the floor member $F_n$ at the uppermost stage is used as a fulcrum O, and a linear frame member FR connected to the rear ends of the remaining floor members $F_1$ to $F_{n-1}$ is caused to rotate about the fulcrum O by a desired angle upwards, for example. During such rotation, the horizontal posture of the movable floor members $F_1$ to $F_{n-1}$ can be maintained by providing a parallel link mechanism such that movable portions associated with the respective floor members are restricted with respect to each other. To this end, as shown in FIG. 5(*b*) for example, the floor members $F_1$ to $F_n$ including the stationary floor member are connected to each other by a link element LN which extends in parallel with the frame member FR.

When, however, the overall inclination of the tiered stands and hence that of the plurality of floor members is changed in the manner explained above, as shown in FIG. 5(*a*), the floor member $F_1$ at the lowermost stage protrudes forwards by a relatively large horizontal distance P along with a decrease in the inclination, so that the projected planar space of the stands in their architectural design cannot be maintained constant. Also, when it is necessary to provide a stationary structure, such as fence, in front of the floor member $F_1$ at the lowermost stage, as in ice hockey stadium, there still remains a problem that the floor member $F_1$ at the lowermost stage is brought into interference wit such a stationary structure.

With the above-mentioned known arrangement, furthermore, the depth of each tier increases as the inclination becomes less steep, thereby giving rise to a problem that it is at any time difficult to optimize the desired level difference between the tiers, the desired location and the desired height of the seats provided on each tier, hence the eye position and visual field of the spectator on the seat.

Therefore, it is an object of the present invention to provide variable floor height tiered stands in which longitudinal displacement and variation in depth of the tiered floor member of the stands are minimized when the inclination of the tier floor members is changed, thereby allowing planning of the tiered stands with a constant installation space, and eliminating the risk of interference between the stands and any stationary structure, while facilitating settings of the desired level difference between the tiers, the desired location and the desired height of the seats provided on each tier, and the like.

DISCLOSURE OF THE INVENTION

According to the present invention, there is provided variable floor height tiered stands comprising a plurality of movable floor members extending horizontally and arranged in the form of tiers, said floor members being adapted to be unitarily rotated by a swing arm about a fulcrum which is provided for a support member of a stationary floor member at the uppermost stage so as to change inclination of the floor members, wherein said fulcrum is located at a cross point between the support member of the stationary floor member at the uppermost stage and the horizontal segment or a segment in parallel therewith, which substantially bisects a vertical segment representing a vertical displacement of the movable floor member at the lowermost stage when the movable floor members are caused to undergo a parallel displacement vertically between the desired maximum inclination position and the minimum inclination position; and a swing arm is provided and has a length that allows connection between said fulcrum and a rear end of the movable floor member at the lowermost stage before or after the vertical displacement, will all the movable floor members connected to the swing arm.

This is shown in the conceptual views of FIGS. 6(*a*) and (*b*). Thus, when each of the movable floor members $F_1$ to $F_{n-1}$ are moved unitarily between the maximum inclination position of the floor members $F_1$ to $F_n$ indicated by the solid line in FIG. 6(*a*) and the minimum of the floor members indicated by the imaginary line, and the movable floor member $F_1$ at the lowermost stage is vertically displaced by an amount A, a cross point CR is formed between a horizontal segment HZ on one hand, which bisects a vertical segment $a_1$ or $a_2$ connecting the positions of the front or rear edge of that floor member $F_1$ before and after the displacement, and the support member SP of the stationary floor member $F_n$ at the uppermost stage, on the other hand. As further shown in FIG. 6(*b*), a swing arm SA is provided and has a length that allows the connection of the fulcrum and the rear edge of the movable floor member $F_1$ at the lowermost stage before the vertical displacement, for example, with all the movable floor members $F_1$ to $F_{n-1}$ connected to the swing arm SA.

With such an arrangement, by causing an angular displacement of the swing arm SA between the maximum and minimum inclination positions indicated in the figure by the solid line and the imaginary line, respectively, it is possible to afford the desired vertical displacement amount A to the movable floor member $F_1$ at the lowermost position. In this instance, the front edge of that floor member $F_1$ is spaced from the support member SP by the same horizontal distance before and after the vertical displacement.

In this way, by causing the swing arm to undergo a symmetrical angular displacement with reference to a neutral position which is defined by the bisection HZ of the vertical segment $a_1$ or $a_2$ connecting the positions of the floor member F1 before and after the displacement, the desired vertical displacement amount A is afforded to the floor member $F_1$. Therefore, not only the front edge of the floor member $F_1$, but also the front ends of the floor members $F_2$ to $F_{n-1}$ connected to the swing arm SA can be located at the constant horizontal positions with reference to the support member SP before and after their displacements. Moreover, in relation to the position of the fulcrum of the swing arm SA, the swing arm itself can be made much shorter than the linear frame member FR as shown in FIGS. 5(*a*) and (*b*), thereby making it possible to reduce the maximum forward projection amount δ of the floor member $F_1$ during its angular displacement, to a value that is negligibly small as compared with the horizontal distance P as also shown in FIGS. 5(*a*) and (*b*).

Thus, with the tiered stands according to the present invention, when the inclination of a plurality of floor member is to be changed, it is possible to minimize the forward projection amount of the floor member $F_1$ at the lowermost stage, so that the planar projected space of the stands in the architectural plan can be maintained constant and the risk of interference between the movable stand $F_1$ and any stationary structure can be sufficiently eliminated. Further, the depth of the floor members before and after the change in their inclination can be made substantially the same with each other, thereby facilitating optimum setting of the required height of the floor members with respect to each other, as well as the required location of the seats on the floor members and the required height of the seats.

Moreover, since the maximum forward projection amount δ of the floor member $F_1$ during the angular displacement of the swing arm SA is very small, there is no noticeable inconveniences as a tiered stands even when the floor members $F_1$ to $F_n$ are set to any intermediate inclination position between the maximum and the minimum inclination positions.

By the way, in consideration of a situation in which the movable floor members $F_1$ to $F_{n-1}$ are actually connected to the respectively predetermined locations of the swing arm SA with a predetermined level difference relative to each other, the movable floor member $F_1$ at the lowermost stage has its rear end connected to the front end of the swing arm SA, as shown in the conceptual views of FIGS. 6(*a*) and (*b*), and it is thus difficult to preserve a high connection strength.

Therefore, as shown in FIG. 7 by way of example, the above-mentioned bisector HZ is translated downwards in the figure by a predetermined amount, without changing the length and the range of the angular displacement of the swing arm itself. The cross point $CR_1$ between the translated bisector HZ and the support member SP of the stationary floor member $F_1$ is used as the fulcrum of the swing arm SA. The movable floor members $F_1$ to $F_{n-1}$ are connected to the respectively predetermined locations of the swing arm SA through stays having a required height, with the fixed connections reinforced by braces, as the case may be.

When all the movable floor members $F_1$ to $F_{n-1}$ are connected to the swing arm SA through stays as mentioned above, it is possible to appropriately increase the length of the swing arm SA with reference to its functionally required length, for the convenience in terms of structure of the tiered stands or the like. On the contrary, in the case of arrangement wherein the movable floor member $F_1$ in particular at the lowermost stage has its rear end directly connected to the front end of the swing arm SA, as shown in FIG. 6(*b*), when the length of the swing arm is increased with reference to the predetermined length, there may be caused inconvenience wherein the extended portion of the swing arm SA projects upwards beyond the floor member $F_1$ in the decreased inclination condition as indicated by the imaginary line in that figure.

Incidentally, when the movable floor members $F_1$ to $F_{n-1}$ are secured to the swing arm SA through the respective stays as shown in FIG. 7, it is possible to assure parallel displacements of the floor members during the angular displacement of the swing arm SA. To this end, for example, each stay is pivotally connected to the swing arm SA, and a link member LN extending in parallel with the swing arm SA is pivotally connected to the stays and the support member SP, to thereby form a parallel link mechanism. Alternatively, as shown in FIG. 8, there may be provided a link member LN which extends in parallel with the swing arm SA and which is pivotally connected at its rear end to another stationary member, while auxiliary column members projecting downwards from the respective front ends of the movable floor members are pivotally connected to the link member LN.

FIG. 9 shows another mode of connecting the movable floor members $F_1$ to $F_{n-1}$ to the swing arm SA and the link member LN. In this instance, stays are provided, which are pivotally connected to the swing arm SA and the link member LN, and which project downwards from substantially center portions of the respective movable floor members $F_1$ to $F_{n-1}$ as seen in the fore-and-after direction.

Therefore, in the tiered stands according to the present invention, it is preferred that the parallel displacements of the movable floor members $F_1$ to $F_{n-1}$ are achieved by pivotally connecting, either directly or indirectly, the movable floor members $F_1$ to $F_{n-1}$ to the link member which extends in parallel with the swing arm SA. Moreover, when the link member is comprised of a plurality of beam members which extend in parallel with each other, it is possible to achieve facilitated purchase and machining of the material as compared to the preparation of a unitary elongate link member.

In the tiered stands as explained above, the stationary floor member $F_n$ at the uppermost stage can be unitarily displaced, together with its support member SP and other movable floor members $F_1$ to $F_{n-1}$, under the operation of casters or the like provided for a base floor member, for example, so as to change the installed position, if necessary.

Furthermore, the tiered stands as explained above is preferably provided with a plurality of swing arms having different lengths, of which longer swing arms are arranged on the lower side, and a shorter swing arm has a front end which is pivotally connected to the movable floor member secured to an adjacent swing arm which is situated on the lower side thereof.

It is also preferred that a plurality of swing arms are provided in parallel with each other, of which at least one swing arm, except the swing arm for the uppermost stage, is spaced from the support member of the stationary floor member and has a rear end which is engaged in a vertically elongate swing guide groove, and of which the swing arm situated on the upper side has a front end pivotally connected to a movable floor member which is secured to an adjacent swing arm on the lower side thereof.

These embodiments are particularly advantageous for the tiered stands with a large number of the movable floor members since, from viewpoint of structural strength, the vertical load can be distributed to, and supported by the plurality of swing arms, and since the length of the column members for pivotally connecting the movable floor members to the respective swing arms can be significantly reduced with respect to the floor members on the upper stage side, in particular. In the tiered stands according to the latter embodiment, provision of the spaced swing arms serves to effectively reduce the length of the swing arms as compared to the former embodiment.

By the way, in the tiered stands according to the latter embodiment, when at least one swing arm is angularly displaced, the spaced swing arms are each caused to undergo angular displacement as if they have fulcrums at the cross points of their imaginary extensions with the support member of the stationary floor member, as being guided by the swing guide grooves. It is therefore possible to cause the desired vertical displacement of the movable floor members on the respective swing arms.

BEST MODE FOR CARRYING OUT THE INVENTION

Figure 10:
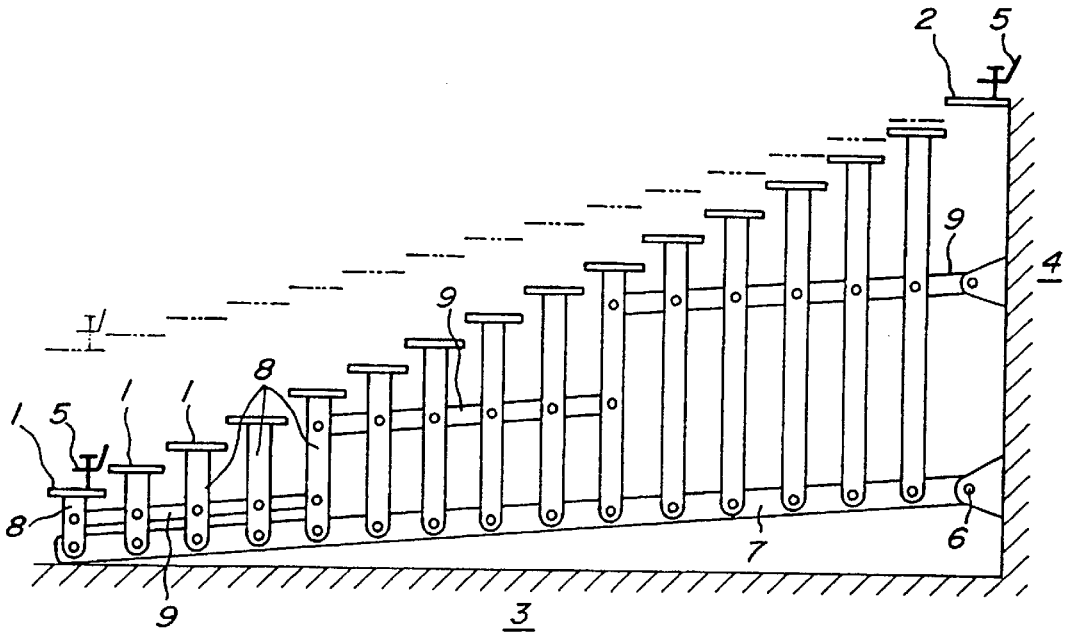
FIG. 10 is a side view showing one embodiment of the present invention.

Variable floor height tiered stands as show in FIG. 10 are comprised of fifteen movable floor members 1 extending horizontally and arranged with predetermined vertical distance relative to each other in the form of tiers, and a stationary floor member 2 which is formed of a floor member at the uppermost stage. The stationary floor member 2 is supported, for example, by a wall member 4 which is either immovable or unitarily movable with a base floor 3 or the like.

On each of the floor members 1, 2, there are arranged a number of connected seats 5 on which spectators can be seated for watching various sorts of athletics or the like.

Figure 6A:
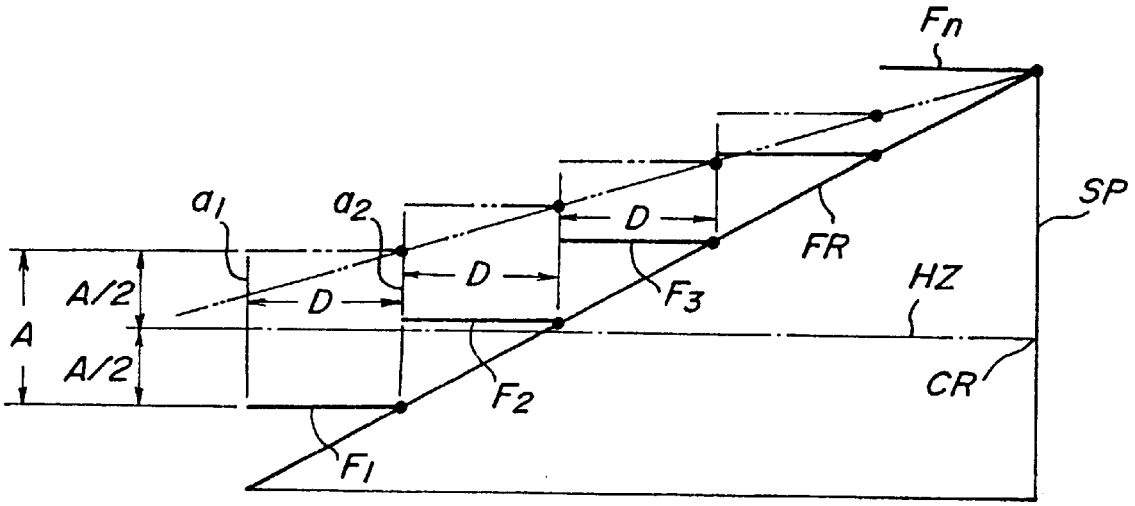
FIGS. 6(*a*) and (*b*) are explanatory views showing the basic concept of the present invention.
Figure 6B:
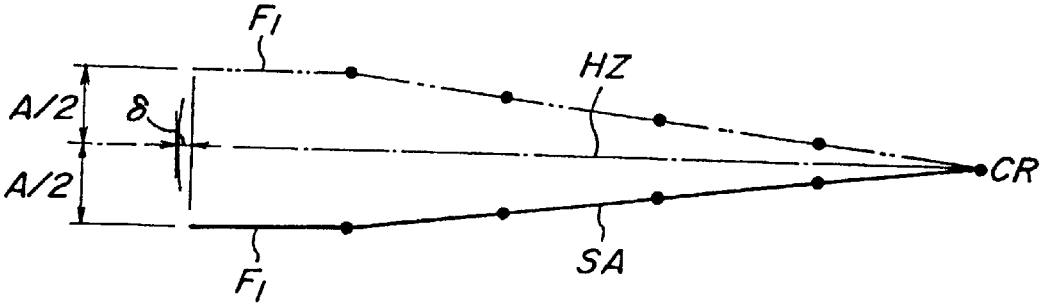
Figure 7:
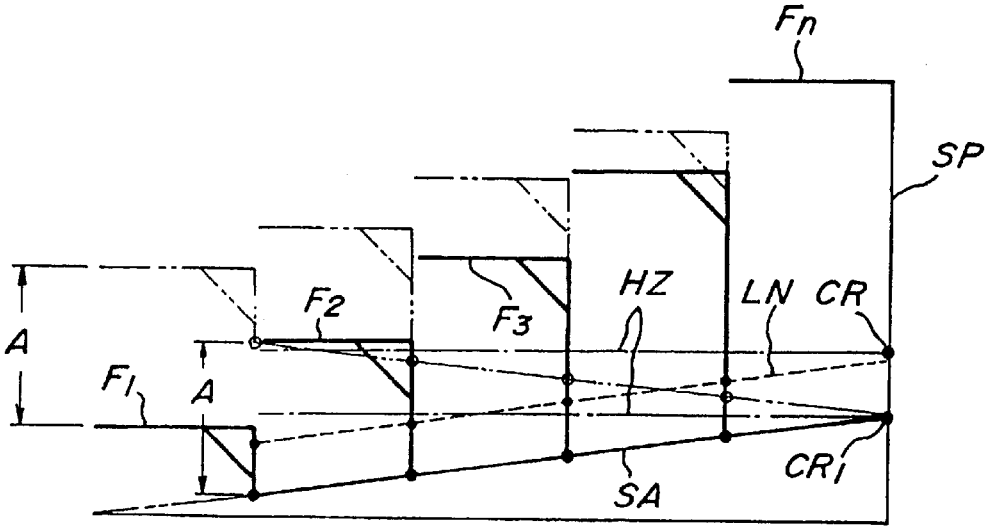
FIG. 7 is a schematic side view showing the manner of securing the swing arm to the movable floor member and parallel link mechanism.
Figure 8:
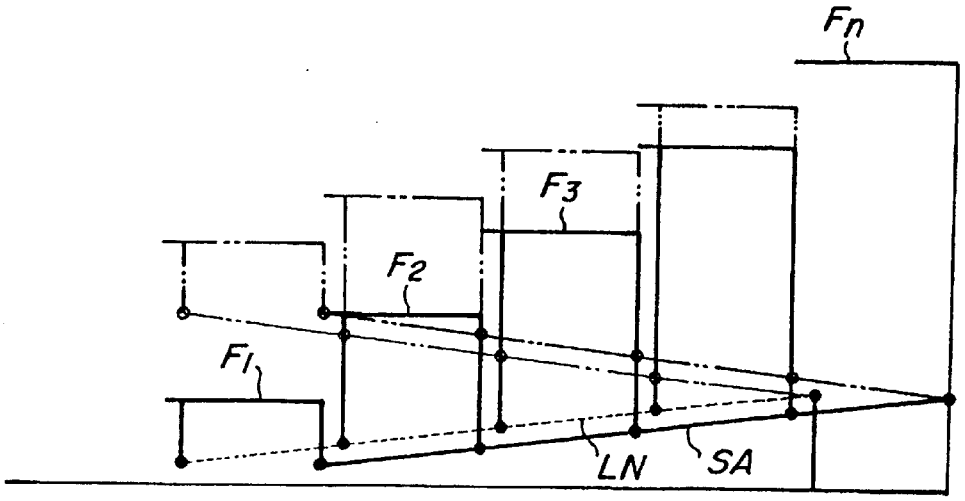
FIG. 8 is a schematic side view showing another example of the parallel link mechanism.
Figure 9:
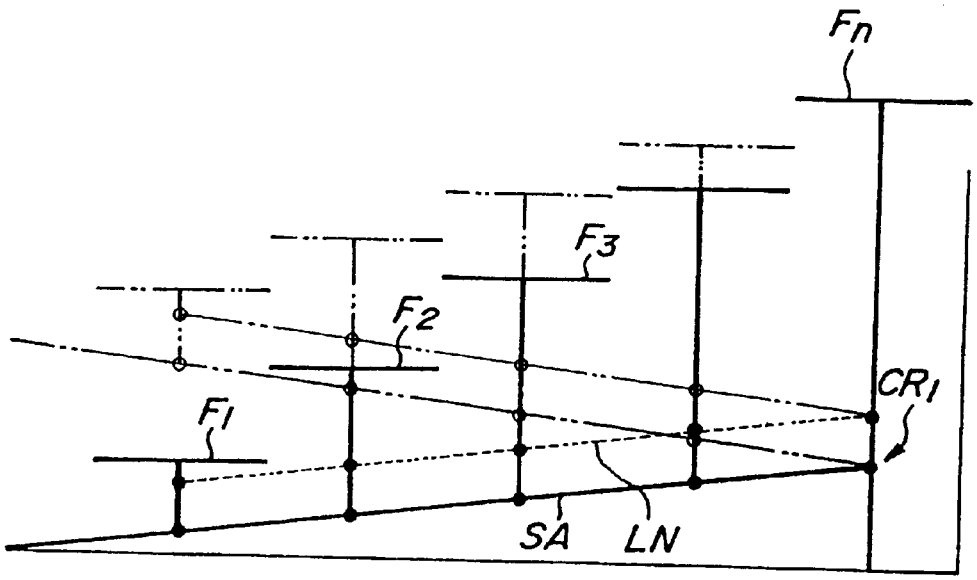
FIG. 9 is a schematic side view showing another example of the manner of securing the movable floor member.

In accordance with what has been explained above with reference to FIGS. 6(*a*) and (*b*) and FIG. 7, there is provided a swing arm 7 having a functionally predetermined length and a fulcrum 6 at a predetermined position relative to the wall member 4. Each floor movable member 1 has a center portion as seen in the fore-and-after direction, from which a column member 8 projects downwards such that the lower end of the column member 8 is pivotally connected to the swing arm 7. Furthermore, there is provided a link member which extends in parallel with the swing arm 7 and which, in the illustrated embodiment, is comprised of three beam members 9. These beam members 9 are pivotally connected to the respective column members 8 at their intermediate positions. Thus, the beam members 9, the respective column members 8 and the swing arm 7, as a whole, constitute a parallel link mechanism which assures substantially parallel displacement of the floor members 1 in the vertical direction, as a result of an angular displacement of the swing arm 7.

In order to maintain a desired level difference of the movable floor members relative to each other, the column member 8 situated on the rear stage side is made longer. From the viewpoint of structural strength, it is preferred that each column member 8 projects substantially at right angles to the relevant floor member 1

By the way, among the three beam members 9 of the parallel link mechanism provided in place of a single elongate link member, the beam member 9 on the side of the upper stages has a rear end pivotally connected to the wall member 4. The front end of this beam member 9 is pivotally connected to the column member 8 which, in turn, is also connected with the rear end of the beam member 9 on the side of the intermediate stages. Furthermore, the front end of the beam member 9 on the side of the intermediate stages is pivotally connected to the column member 8 which, in turn, is also connected with the rear end of the beam member 9 on the side of the lower stages. Thus, the wall member 4 and the three beam members 9 are associated with each other to form part of the parallel link mechanism.

In the tiered stands having a structure as explained above, the floor members 1, 2 assume the maximum inclination positions in the illustrated position of the swing arm 7 corresponding to the swing arm 7 which has undergone an angular displacement to its predetermined lower limit position relative to the bisector HZ, as shown in FIG. 6(*b*) and FIG. 7. On the other hand, the floor members 1, 2 assume the minimum inclination positions as indicated by imaginary lines in the figure, where the swing arm 7 has undergone an displacement upwards to its symmetrical position relative to the bisector HZ.

When the inclination is changed as above, the movable floor members 1 are displaced upwards while maintaining their horizontal posture due to the operation of the above-mentioned parallel link mechanism. Besides, since the swing arm 7 is angularly displaced between the positions which are symmetrical to the above-mentioned bisector HZ, each movable floor member 1 assumes a position after the inclination has been changed, which is exactly above the position assumed by that floor member 1 before the change in inclination is performed.

Figure 1:
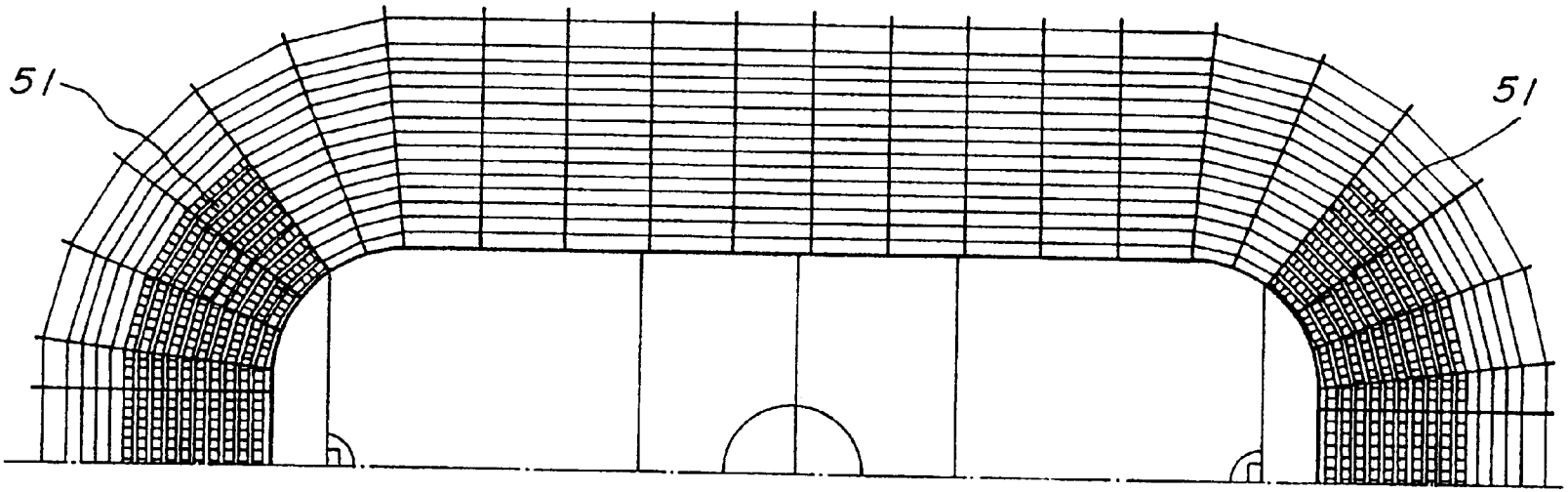
FIG. 1 is a half plan view of a stadium which is used for ice hockey game.
Figure 2:
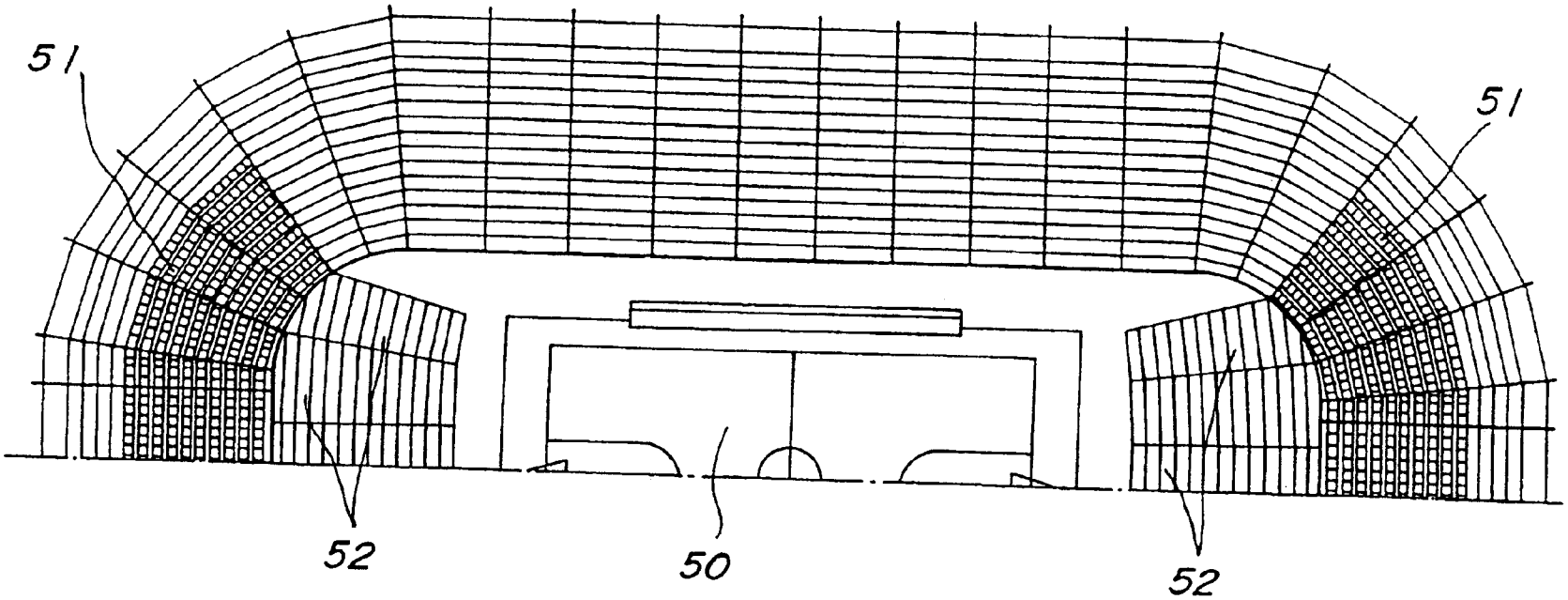
FIG. 2 is a half plan view showing an example wherein the stadium of FIG. 1 is provided with a basket court.
Figure 3:
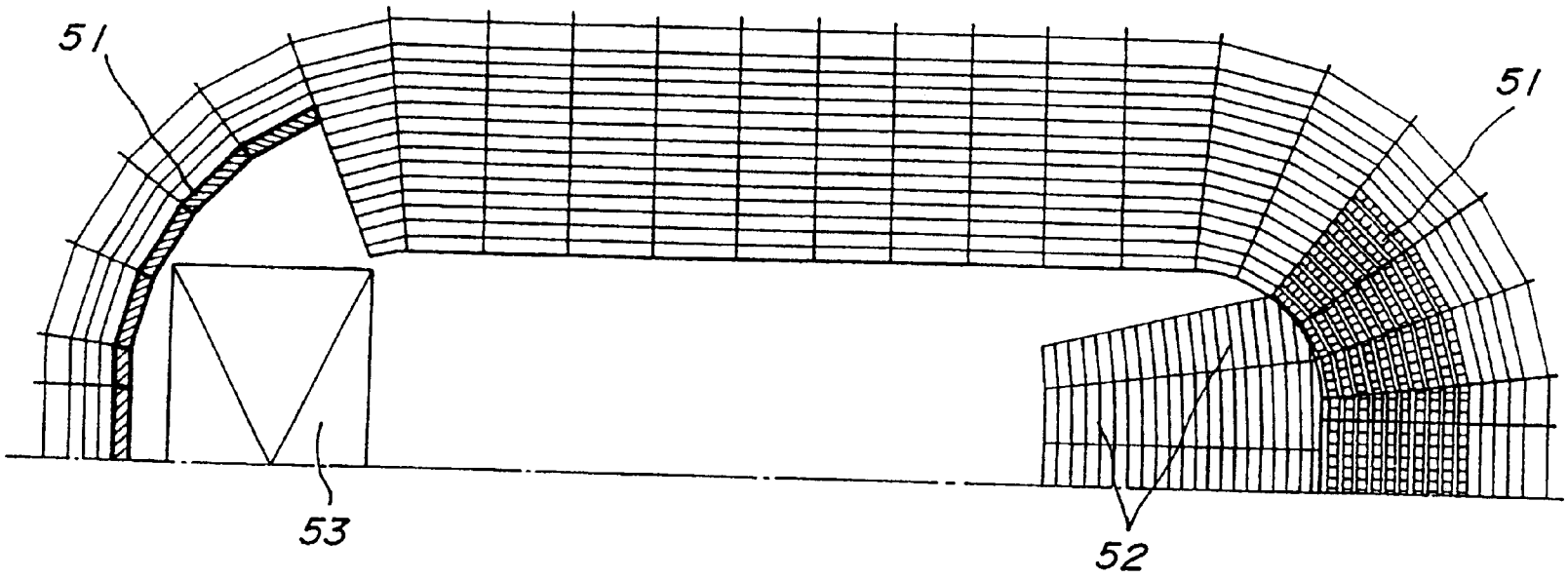
FIG. 3 is a half plan view showing another example wherein the stadium of FIG. 1 is provided with a stage.
Figure 4A:
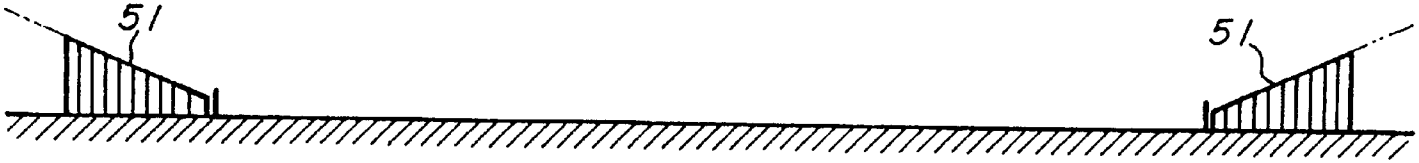
FIGS. 4(*a*) to (*c*) are schematic sectional views showing preferred arrangements of the stands for each of the application modes.
Figure 4B:
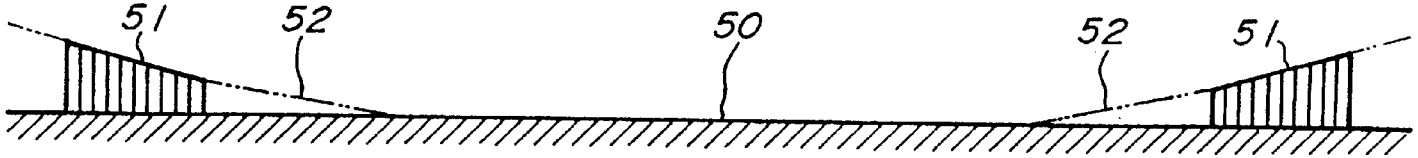
Figure 4C:
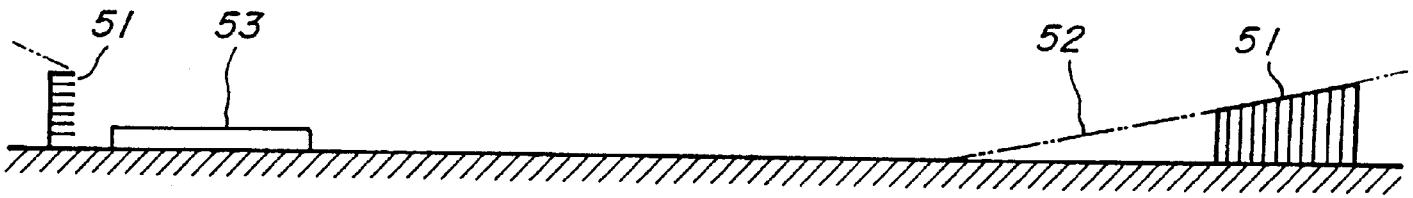
Figure 5A:
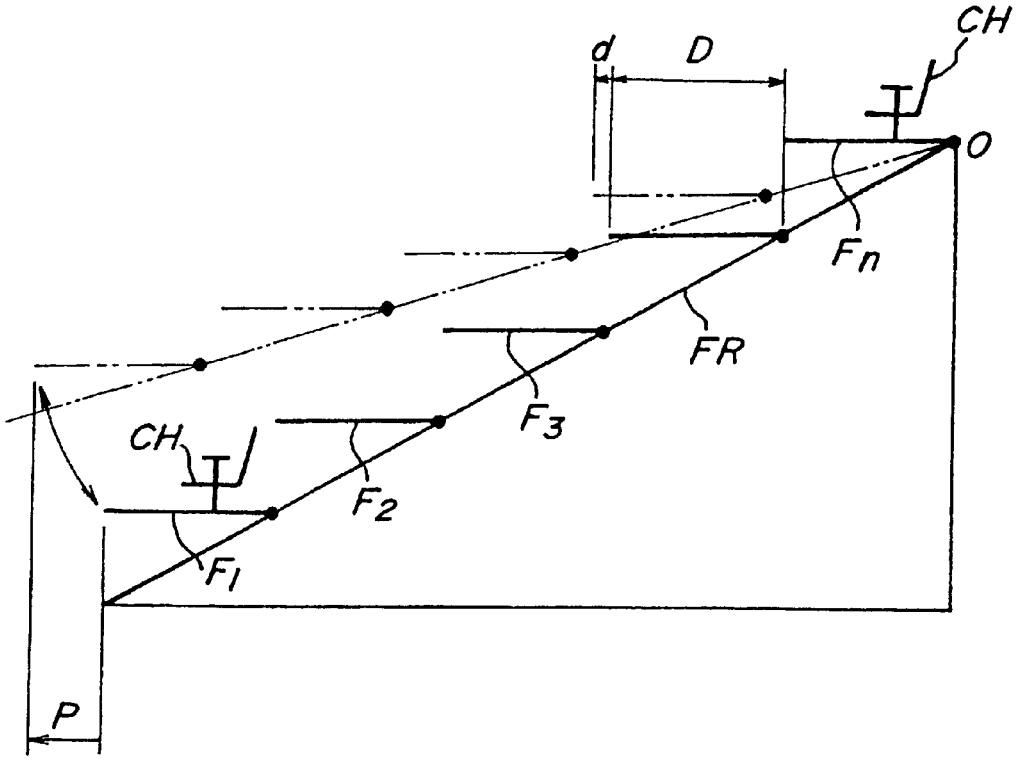
FIGS. 5(*a*) to (*b*) are schematic side views showing examples in which the inclination of the tiered stands has been changed.
Figure 5B:
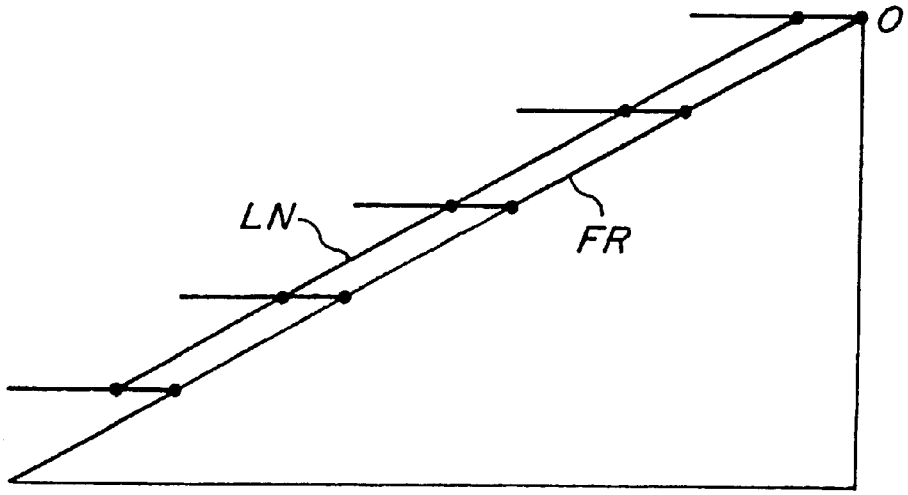

Therefore, with the above-mentioned embodiment, it is possible to prevent the movable floor member 1 at the lowermost stage from significantly projecting forwards as explained with reference to FIGS. 5(*a*) and (*b*), when the inclination of the tiered stands is changed from the maximum inclination to the minimum inclination. Moreover, there is no change in the depth of the floor members at the respective stages.

By the way, even with the tiered stands according to the illustrated embodiment, the change in the inclination is performed as a result of the angular displacement of the swing arm about the fulcrum 6. Therefore, particularly when the swing arm assumes a position coinciding with the above-mentioned bisector HZ, the movable floor member 1 at the lowermost stage necessarily projects forwards. However, since the swing arm 7 has a significantly reduced length as explained above, it is possible to reduce the maximum forward projection amount $\delta$ to a value that is negligibly small as compared with the amount as shown in FIG. 5(*a*), so that there is no significant influence over the planar projected space of the stands in the architectural plan.

The above-mentioned functional advantages can be also fully achieved even when the floor members 1, 2 are set to their intermediate inclination between the maximum inclination and the minimum inclination.

Figure 11A:
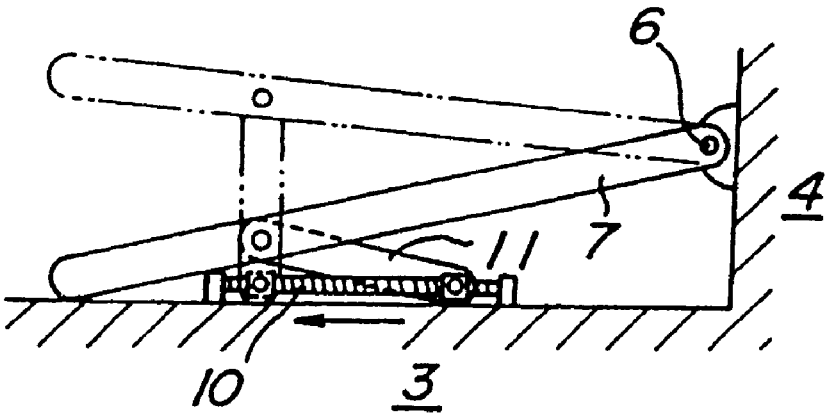
FIGS. 11(*a*) and (*b*) are schematic side views showing example of angular drive means for the swing arm.
Figure 11B:
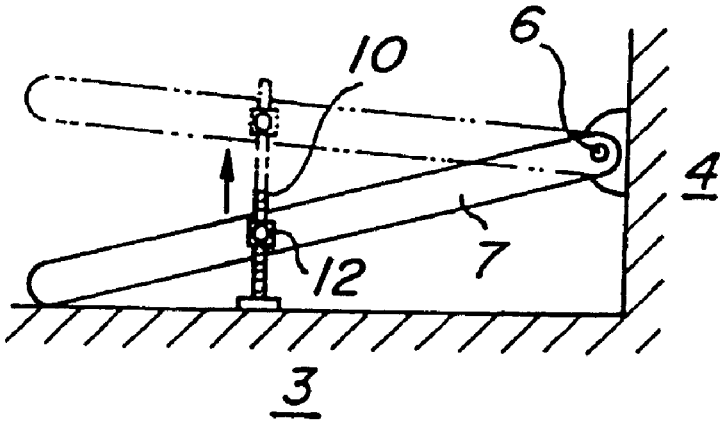

FIGS. 11(*a*) and (*b*) are schematic side views showing examples of angular drive mechanism for the swing arm of the above-mentioned tiered stands. In the example shown in FIG. 11(*a*), a male thread member 10 is horizontally supported on the base floor 3 by journal bearings and is engaged with a female thread member which is provided on one end of an arm member 11. Another end of the arm member 11 is pivotally connected to the intermediate portion of the swing arm 7. It is assumed that the relative posture between the arm member 11 and the female thread member at its one end is variable.

With such an arrangement, when the male thread member 10 is rotated by a motor or the like, not shown, the female thread member at one end of the arm member 11 is axially displaced along the male thread member 10 such that the other end of the arm member 11 causes an angular displacement of the swing arm 7 by a desired amount, between the positions indicated by the solid line and the imaginary line, respectively.

In the drive mechanism shown in FIG. 11(*b*), the male thread member 10 is vertically supported on the base floor 3 by journal bearings and is engaged with a female thread member 12 which is provided for the swing arm 7, and it is assumed that the posture of the female thread member 12 is variable relative to the swing arm 7.

With this example of the drive mechanism, when the male thread member 10 is rotated by a motor or the like, not shown, the swing arm can be directly operated to undergo an angular displacement by a desired amount.

While the angular drive mechanism for the swing arm 7 has been described with reference to specific examples using a thread mechanism, the drive mechanism is not limited to these examples and may be comprised of hydraulic or pneumatic mechanism, besides a conventional elevator mechanism using gears, chains or the like.

Figure 12:
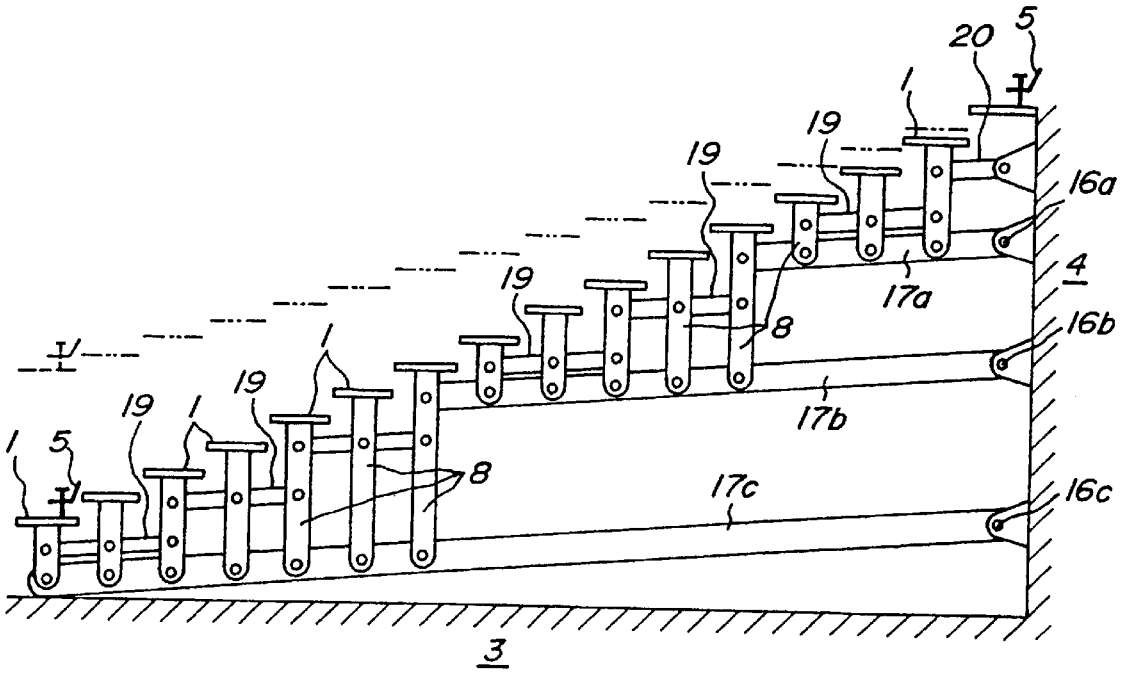
FIG. 12 is a side view showing another embodiment of the present invention.

FIG. 12 is a side view showing another embodiment of the present invention, wherein three swing arms 17*a*, 17*b*, 17*c* having mutually different lengths are pivotally connected to the wall member so that they can be angularly displaced about their fulcrums 16*a*, 16*b*, 16*c*, respectively.

In this instance, it is assumed that the shorter swing arm is arranged on the upper side of the wall member 4. As for the shortest swing arm 17*a*, the position of the fulcrum 16*a* and the arm length are determined in accordance with what has been described above with reference to FIGS. 6(*a*) and (*b*) and FIG. 7, so as to ensure that the inclination of four movable floor members 1 on the upper side, inclusive of the movable frame member 1 at the uppermost stage, can be changed whenever necessary. Similarly, as for the swing arm 17*b* having an intermediate arm length, the position of the fulcrum 16*b* and the arm length are determined in accordance with what has been described above with reference to FIGS. 6(*a*) and (*b*) and FIG. 7, so as to ensure that the inclination of nine movable floor members 1 on the upper side, inclusive of the movable floor member 1 at the uppermost stage, can be changed whenever necessary. Finally, the position of the fulcrum 17*c* and the arm length of the longest swing arm 17*c* are determined so as to ensure that the inclination of all of the movable floor members 1 can be changed whenever necessary.

Furthermore, the swing arm 17*b* having an intermediate length has a front end which is pivotally connected to any one of the column members of the seven movable floor members 1 situated on the lower side, which are pivotally connected to the longest swing arm 17*c*, i.e., to the column member 8 of the movable floor member 1 at the uppermost side, among the seven movable floor members 1, in the illustrated embodiment. Similarly, the shortest swing arm 17*a* has a front end which is pivotally connected to the column member 8 of the movable floor member 1 at the uppermost stage, among the movable frame members 1 which are pivotally connected to the swing arm having an intermediate length. In this way, the three swing arms 17*a*, 17*b*, 17*c* are functionally associated with each other, besides that the two swing arms 17*a*, 17*b* on the upper side contribute to form part of a parallel link mechanism.

Moreover, in order to realize the parallel link mechanism as mentioned above, beam members 19 having the same length and extending in parallel with the swing arms 17*a*, 17*b*, 17*c* are each pivotally connected to three column members 8, for example. Reference numeral 20 in the figure denotes a different kind of beam member which serves to connect the column member 8 of the movable floor member 1 at the uppermost stage, to the wall member 4. Instead of providing such a beam member 20, it is also possible to pivotally connect the rear end of the beam member 19, which is situated at the uppermost side, to the wall member 4.

With such an arrangement of the tiered stands, when the inclination of the movable floor members 1 is to be changed, at least one swing arm is angularly displaced to achieve functional advantages which are essentially the same as those explained above.

Also, this arrangement is significantly advantageous in various aspects. In terms of manufacturing process, the length of the column member 8 for the movable floor members at the upper stage side can be substantially reduced, as compared to that in the previous embodiment, and the beam members 19 can be standardized to have the same length. In terms of structural strength, furthermore, the load applied to the respective movable floor members 1 can be distributed to, and supported by the three swing arms 17*a*, 17*b*, 17*c* so as to avoid concentration of the load to a specific swing arm and fulcrum therefor.

Figure 13:
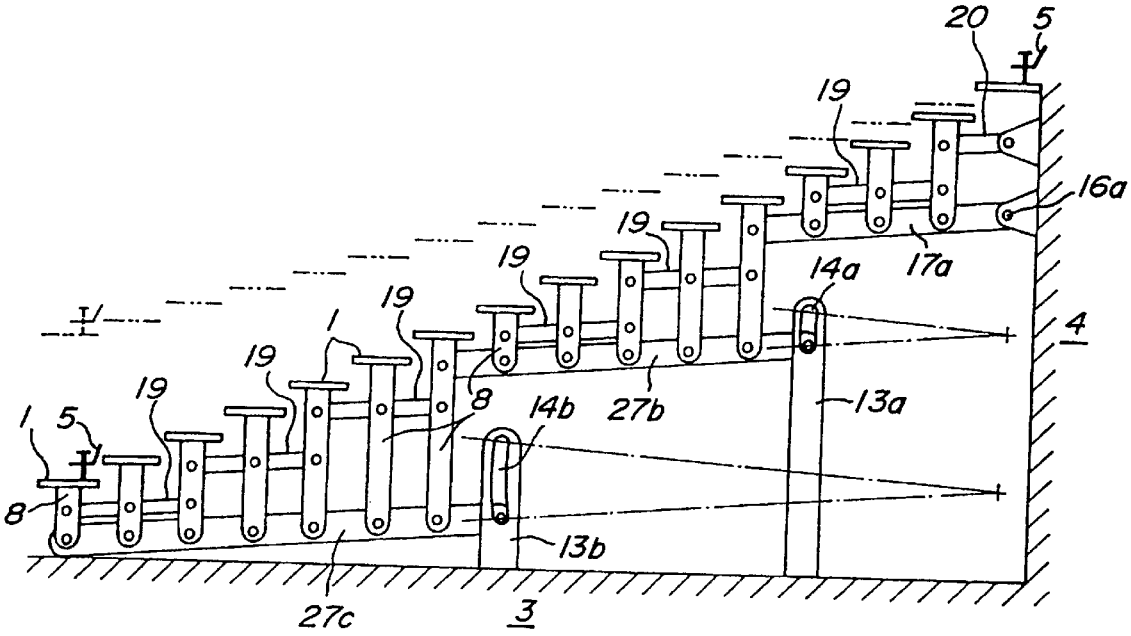
FIG. 13 is a side view showing still another embodiment of the present invention.

Another embodiment of the present invention is shown in FIG. 13, which has been advanced from that of FIG. 12, and in which the swing arm 17*b* having an intermediate length and the longest swing arm 17*c* shown in FIG. 12 are replaced by swing arms 27*b*, 27*c*, respectively, which are terminated halfway and thus spaced from the wall member 4 without being pivotally connected thereto. The rear ends of these swing arms 27*b*, 27*c* are engaged in elongate swing guide grooves 14*a*, 14*b* which extend vertically in guide columns 13*a*, 13*b* projecting from the base floor 3.

It is assumed that the swing guide grooves 14*a*, 14*b* have predetermined lengths that allow the swing arms 27*b*, 27*c* to be angularly displaced within respectively desired angular ranges, about their imaginary fulcrums which correspond, respectively, to the positions of the fulcrums 16*b*, 16*c* in FIG. 12. It is therefore preferred that the shape of the swing guide grooves as seen in the side view is arcuate, though the groove shape may be linear provided that the rear ends of the swing arms 27*b*, 27*c* are displaced along a trajectory which does not give rise to practical inconvenience in achieving the desired functional advantages.

Here, the inclination of the floor members can be preferably achieved by causing angular displacement of a plurality of swing arms with a feeding thread mechanism, hydraulic or pneumatic mechanism or the like. In this instance, when a plurality of swing guide grooves 14*a*, 14*b* are provided as shown in the figure, it is preferred that the operations of the swing arms 27*b*, 27*c* relative to each other are synchronously controlled by appropriate mechanical or electrical means.

Based on the angular displacement of the swing arms 17*a*, 27*b*, 27*c*, the tiered stands according to the above-mentioned embodiment achieve functional advantages which are essentially same as those explained with reference to FIGS. 10 and 12, as well as the structural advantage of the tiered stands shown in FIG. 12, besides an improved manufacturing productivity due to the reduced lengths of the swing arms 27*b*, 27*c*, since the materials can be readily purchased and machined in a standardized manner.

Figure 14:
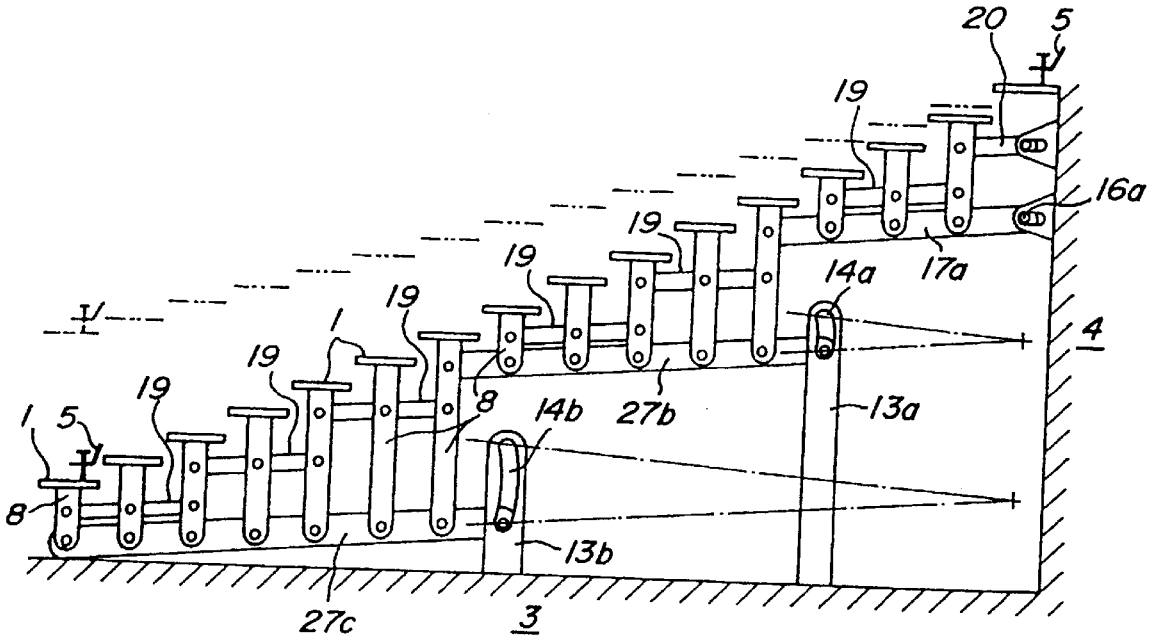
FIG. 14 is a side view showing yet another embodiment of the present invention.

Another embodiment of the present invention is shown in FIG. 14, which has been further developed from that of FIG. 13, and which serves to sufficiently absorb the forward projection of the front end of the swing arm when the inclination of the floor members is changed by an angular displacement of the swing arm, such that the amount of horizontal displacement forwards of the floor members can be made substantially zero even when the inclination of the floor members is set to an intermediate inclination between the maximum inclination and the minimum inclination.

To this end, as compared to the embodiment of FIG. 13, the swing guide grooves 14*a*, 14*b* in the respective guide columns 13*a*, 13*b* have the same radius of curvature, though they are curved in opposite sense. Moreover, the position of the fulcrums, where the swing arm 17*a* and the beam member 20 are pivotally connected to the wall member 4, can be shifted in the fore-and-after direction.

With such an arrangement, when the swing arms 27*b*, 27*c* are angularly displaced upwards from the illustrated positions, under a synchronizing control and about their respective imaginary fulcrums as explained above, the rear ends of the swing arms 27*b*, 27*c*, which would be originally displaced along the swing guide grooves 14*a*, 14*b* in FIG. 13, are displaced such that the original displacement is cancelled, thereby making it possible to effectively prevent the forward horizontal displacement of the floor members, even when the inclination of the floor members is set to an intermediate inclination between the maximum inclination and the minimum inclination. In this instance, the fulcrums for the swing arm 17*a* and the beam member 20 are shifter rearwards by an amount corresponding to the horizontal deflection of the swing guide grooves 14*a*, 14*b* shown in FIG. 14.

Industrial Application Field

It will be readily appreciated from the foregoing description that the variable floor height tiered stands according to the present invention serve to minimize the horizontal displacement amount of a plurality of floor members in the fore-and-after direction and change in the depth of the floor members when the heights of the respective floor members and hence the inclination of the tiered stands. It is therefore possible to maintain constant the planar projected space of the stands in the architectural plan and eliminate the risk of interference between the tiered stands and any stationary structure in changing the inclination. It is further possible to facilitate calculations of the required level difference of the floor members relative to each other, as well as the required location and height of the seats to be provided on the floor members.

What is claimed is:

1. Variable floor height tiered stands comprising a plurality of movable floor members extending horizontally and arranged in the form of tiers, said floor members being adapted to be unitarily rotated by a swing arm about a fulcrum which is provided for a support member of a stationary floor member at an uppermost stage so as to change inclination of the floor members, wherein:

said fulcrum is located at a cross point between the support member of the stationary floor member at the uppermost stage and a horizontal segment or a segment in parallel therewith, which substantially bisects a vertical segment representing a vertical displacement of the movable floor member at a lowermost stage when the movable floor members are caused to undergo a parallel displacement vertically between the desired maximum inclination position and the minimum inclination position, and a swing arm is provided and has a length that allows connection between said fulcrum and a rear end of the movable floor member at the lowermost stage before or after the vertical displacement, with all the movable floor members being connected to the swing arm.

2. The variable floor height tiered stands according to claim 1, wherein the movable floor members are pivotally connected to a link member which extends substantially in parallel with the swing arm.

3. The variable floor height tiered stands according to claim 2, wherein said link member is comprised of a plurality of beam members which extend in parallel with each other.

4. The variable floor height tiered stands according to claim 1, wherein a plurality of swing arms having different lengths are provided, of which longer swing arm are arranged on the lower side, and of which a shorter swing arm has a front end which is pivotally connected to a movable floor member secured to an adjacent swing arm situated on the lower side thereof.

5. The variable floor height tiered stands according to claim 1, wherein a plurality of swing arms are provided in parallel with each other, of which at least one swing arm, except the swing arm for the uppermost stage, is spaced from the support member of the stationary floor member and has a rear end which is engaged in a vertically elongate swing guide groove, and of which the swing arm situated on the upper side has a front end pivotally connected to a movable floor member which is secured to an adjacent swing arm on the lower side thereof.

6. The variable floor height tiered stands according to claim 3, wherein a plurality of swing arms having different lengths are provided, of which longer swing arms are arranged on the lower side, and of which a shorter swing arm has a front end which is pivotally connected to a movable floor member secured to an adjacent swing arm situated on the lower side thereof.

7. The variable floor height tiered stands according to claim 3, wherein a plurality of swing arms are provided in parallel with each other, of which at least one swing arm, except the swing arm for the uppermost stage, is spaced from the supper member of the stationary floor member and has a rear end which is engaged in a vertically elongate swing guide groove, and of which the swing arm situated on the upper side has a front end pivotally connected to a movable floor member which is secured to an adjacent swing arm on the lower side thereof.

8. The variable floor height tiered stands according to claim 2, wherein a plurality of swing arms having different lengths are provided, of which longer swing arms are arranged on the lower side, and of which a shorter swing arm has a front end which is pivotally connected to a movable floor member secured to an adjacent swing arm situated on the lower side thereof.

9. The variable floor height tiered stands according to claim 2, wherein a plurality of swing arms are provided in parallel with each other, of which at least one swing arm, except the swing arm for the uppermost stage, is spaced from the support member of the stationary floor member and has a rear end which is engaged in a vertically elongate swing guide groove, and of which the swing arm situated on the upper side has a front end pivotally connected to a movable floor member which is secured to an adjacent swing arm on the lower side thereof.

* * * * *